US005267223A

United States Patent [19]

Flanagan et al.

[11] Patent Number: 5,267,223

[45] Date of Patent: Nov. 30, 1993

[54] ELECTROACOUSTIC TRANSDUCER SEAL

[75] Inventors: Peter F. Flanagan, Cranston; Gerald A. Brigham, Portsmouth, both of R.I.

[73] Assignee: Raytheon Company, Lexington, Mass.

[21] Appl. No.: 939,798

[22] Filed: Sep. 3, 1992

[51] Int. Cl.[5] ..... H04R 17/00

[52] U.S. Cl. ..... 367/159; 310/337

[58] Field of Search ..... 367/159, 162, 163, 169, 367/166, 174; 310/337

[56] References Cited

U.S. PATENT DOCUMENTS

| | | | |
|---|---|---|---|
| 4,220,887 | 9/1980 | Kompanek | 310/334 |
| 4,651,044 | 3/1987 | Kompanek | 310/323 |
| 4,949,319 | 8/1990 | Boeglin et al. | 367/154 |
| 5,020,035 | 5/1991 | Kompanek | 367/159 |
| 5,103,130 | 4/1992 | Rolt et al. | 367/159 |
| 5,122,992 | 6/1992 | Kompanek | 367/159 |
| 5,132,942 | 7/1992 | Cassone | 367/159 |

*Primary Examiner*—J. Woodrow Eldred

*Attorney, Agent, or Firm*—Donald F. Mofford; Richard M. Sharkansky

[57] ABSTRACT

A compliant cover for use with acoustic source transducers includes a rubber boot bonded to a shell of the transducer. The cover has a groove molded within a surface thereof to allow the shell to expand and contract with reduced resistance. Conventional transducers having rigidly mounted covers disposed on the shell which resist the motion of the shell and decrease the overall efficiency of the transducer.

12 Claims, 4 Drawing Sheets

ELECTROACOUSTIC TRANSDUCER SEAL

The Government has rights in this invention pursuant to Contract No. N62269-89-C-0578 awarded by the Department of the Navy.

BACKGROUND OF THE INVENTION

This invention relates generally to electroacoustic transducers and more particularly to electroacoustic transducers having an improved watertight seal for increasing operating efficiency and manufacturing ease while decreasing overall transducer size.

As is known in the art, electroacoustic transducers are used in underwater environments to convert electrical energy into acoustic energy and likewise, acoustic energy into electrical energy. When acoustic energy is propagated, the device is generally referred to as a projector; whereas, when such energy is received, the device is referred to as a hydrophone. One hydrophone application is a sonobuoy which often contains a plurality of acoustic transducers. The sonobuoy may be discharged from an aircraft and upon impact, the transducers are ejected and hang several hundred feet down into the water from a buoy which remains on the surface and which contains electrical transmission apparatus. The transducers receive acoustic energy or signals and convert such signals into electrical signals. Such electrical signals are transmitted to the buoy by an interconnecting cable and receiving apparatus, for example disposed on an aircraft or boat, receives such electrical signals. With this arrangement, activity in the water, such as the passing of a ship, can be detected.

Some electroacoustic transducers include a resilient shell which moves or vibrates in response to excitation by either an electromechanical driving mechanism or acoustic energy, in order to propagate or receive acoustic energy, respectively. Several types of resilient shells are conventionally used, such as an elliptical shaped shell having open end portions or a cylindrical shaped shell having one or more slots disposed parallel to the axis of the cylinder. The former type of shell provides what is generally referred to as a flextensional transducer and the latter shell provides a split-ring or split-cylinder transducer. When a split-cylinder transducer has more than one slot, it may be referred to as a multi-slotted cylinder transducer.

Conventional acoustic transducers operating as hydrophones are driven by a variety of electromechanical mechanisms which include natural piezoelectric (e.g. quartz), synthetic piezoelectric (e.g. a ceramic), magnetostriction, variable reluctance (e.g. a magnetic drive), and moving coil drivers. In flextensional transducers and multi-slotted cylinder transducers, the driver is often disposed in a columnar arrangement between opposite ends of the shell. For example, in the case of a flextensional transducer having an elliptical shaped shell, the driver may be disposed between the ends of the shell along the major axis of the ellipse. With this arrangement, when the driver is positively energized, it pushes outward on the ends of the elliptical shell along the major axis and the sides of the shell along the minor axis of the ellipse move inward. When the driver is negatively energized (i.e. when the input signal corresponds to the negative half cycle of the sine wave energizing signal), the ends of the elliptical shell along the major axis move inward and the sides of such shell along the minor axis thereof move outward. In this way, acoustic energy is propagated by periodic excitation of the driver. In split-cylinder transducers, the driver is commonly provided in a cylindrical shape and is coupled to the interior of the cylindrical shell. When such driver is positively energized, the slot is forced open or widened, thereby causing the cylindrical walls to move in the water environment. When the driver is negatively energized, the resilient cylindrical shell contracts to its initial shape. In this manner, acoustic energy is propagated by the periodic excitation of the driver.

The interior of conventional acoustic transducers may be either fluid filled or gas filled. In either case, it is necessary to seal the interior of the shell from the surrounding water environment. One way known in the art for providing a watertight seal is to cover the open ends of the transducer shell with metal end caps or plates spaced from the shell and to cover the entire assembly (including the slot of the split-cylinder transducer) with a flexible cover or "boot." With this arrangement, the shell is free to move upon excitation by the driver mechanism or acoustic energy. However, the movement of the shell may be somewhat inhibited or restricted by the coupling of the shell to the non-flexible metal end caps via the boot. That is, while the flexible boot will move somewhat in response to shell movement, the movement of the boot is restricted by the end caps disposed thereunder. Moreover, inhibition of the shell movement adversely affects the transducer efficiency (i.e. the ratio of acoustic energy output to electrical energy input in the case of a projector and the ratio of electrical energy output to acoustic energy input in the case of a hydrophone) since energy is used in stretching and shearing the boot instead of in propagating acoustic energy.

One way known in the art to improve the efficiency of electroacoustic transducers utilizing conventional watertight seals or boots is to provide slack in the boot material (i.e. a "loop" of boot material between the ends of the shell and the metal end caps spaced therefrom, as described in U.S. Pat. No. 4,949,319 entitled "Sonar Transducer Joint Seal" with inventors Richard W. Boeglin and Arthur B. Joyal, issued on Aug. 14, 1990 and assigned to the assignee of the subject invention. With this arrangement, when the shell moves, the boot is free to move to a greater extent before being restricted by the metal end caps. In fact, this loop feature has also been applied to the slot of split-cylinder transducers, as described in U.S. Pat. No. 5,103,130 entitled "Sound Reinforcing Seal for Slotted Acoustic Transducer" with inventors Kenneth D. Rolt and Peter F. Flanagan, issued on Apr. 7, 1992 and assigned to the assignee of the subject invention. However, while these loop arrangements improve transducer efficiency by decreasing restraint on the shell's motion, further efficiency improvement may be desirable.

SUMMARY OF THE INVENTION

With the foregoing background in mind, it is an object of the invention to provide an electroacoustic transducer having improved efficiency.

Another object of the invention is to provide an electroacoustic transducer having an improved watertight seal with fewer parts, simplified manufacture, and lower cost.

A still further object is to provide a sonobuoy having a transducer with improved efficiency.

An additional object is to provide such a sonobuoy having such an improved transducer that is smaller in size.

These and other objects are attained generally by providing an electroacoustic transducer having a resilient shell with an interior and a pair of opposing ends exposing the interior. The transducer further includes transduction driver means coupled to the resilient shell and means, comprising a compliant material and disposed across at least one of the opposing ends, for sealing the at least one opposing end. Preferably, the compliant material is an elastomer.

With this arrangement, a transducer having improved operating efficiency is provided. More particularly, by sealing the ends of the resilient shell with a compliant material, acoustic energy is propagated from, or received by, such end seals. That is, in operation, when the shell of the transducer moves, the compliant end seals also move. This added movement of the transducer end seals equates to increased output power, thereby increasing the overall efficiency of the transducer. Additionally, the compliant end seal further improves efficiency by providing a watertight seal that allows substantially uninhibited movement of the shell.

In accordance with a further embodiment of the invention, an electroacoustic transducer is provided having a resilient shell with an interior being exposed by a pair of opposing ends and a slot. The transducer further comprises transduction driver means coupled to the resilient shell and means, comprising a unitary compliant member, for sealing at least one of the pair of opposing ends and the slot. In a preferred embodiment, the sealing means comprises means for sealing the pair of opposing ends and the slot and the compliant member is comprised of an elastomer.

With this arrangement, the benefit of improved transducer efficiency is provided, as described above. Additionally, the parts count of the electroacoustic transducer is reduced by providing means for sealing at least one, and preferably two, of the opposing ends and the slot as a unitary member. This reduced parts count in turn, reduces the cost and improves the ease of manufacture, as compared to prior art transducers having metal end caps.

In accordance with a further aspect of the invention, a sonobuoy is provided comprising at least one electroacoustic transducer, with the transducer comprising a resilient shell having an interior and a pair of opposing ends exposing the interior and transduction driver means coupled to said resilient shell. The transducer further comprises a compliant material disposed across at least one of the opposing ends, for sealing such end.

With this arrangement, an improved sonobuoy is provided due to the increased efficiency of the transducer contained therein, as described above. Additionally, the elimination of the prior art end caps or plates reduces the overall length of the transducer, thereby providing additional space in the sonobuoy for other components or allowing for increased transducer shell length while maintaining the overall transducer length constant.

BRIEF DESCRIPTION OF THE DRAWINGS

The aforementioned aspects and other features of the present invention will be apparent from the following description taken in conjunction with the accompanying drawings in which.

DESCRIPTION OF THE PREFERRED EMBODIMENT

Figure 1:
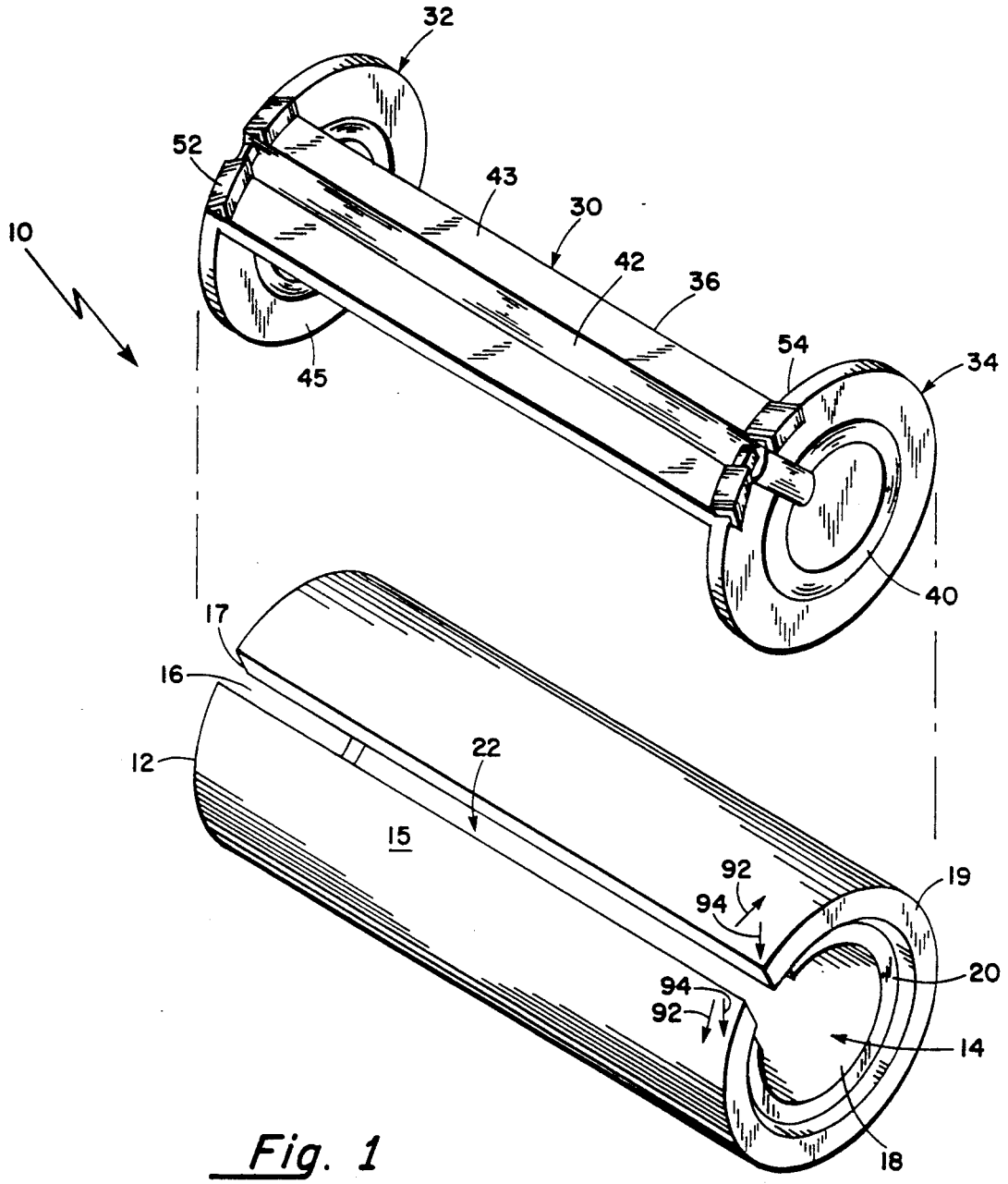
FIG. 1 is an exploded isometric view of an electroacoustic transducer in accordance with the invention.

Referring to FIG. 1, a transducer 10 is shown to include a resilient shell 12 having an interior 14 and a pair of opposing ends 16, 18 exposing the shell interior 14. Transducer 10 here also has a longitudinal slot 22 further exposing the interior 14 and being disposed parallel to the axis of cylindrical shell 12, as shown. A transduction driver 20 is coupled to the resilient shell 12. Also provided, is means 30 disposed across at least one of opposing ends 16, 18 for sealing the at least one opposing end 16, 18. Here, seal 30 is disposed across both of the pair of opposing ends 16, 18 as well as across slot 22. The sealing means 30 is comprised of a compliant material as will be discussed. With this arrangement, an improved watertight seal is provided to the transducer 10. Specifically, the improvement is provided by way of increased transducer operating efficiency, ease of manufacture, and reduced size, as will be discussed. Here, the transduction or electromechanical driver 20 is disposed concentrically within shell 12 and is comprised of a ceramic piezoelectric material, as is conventional.

Figure 2:
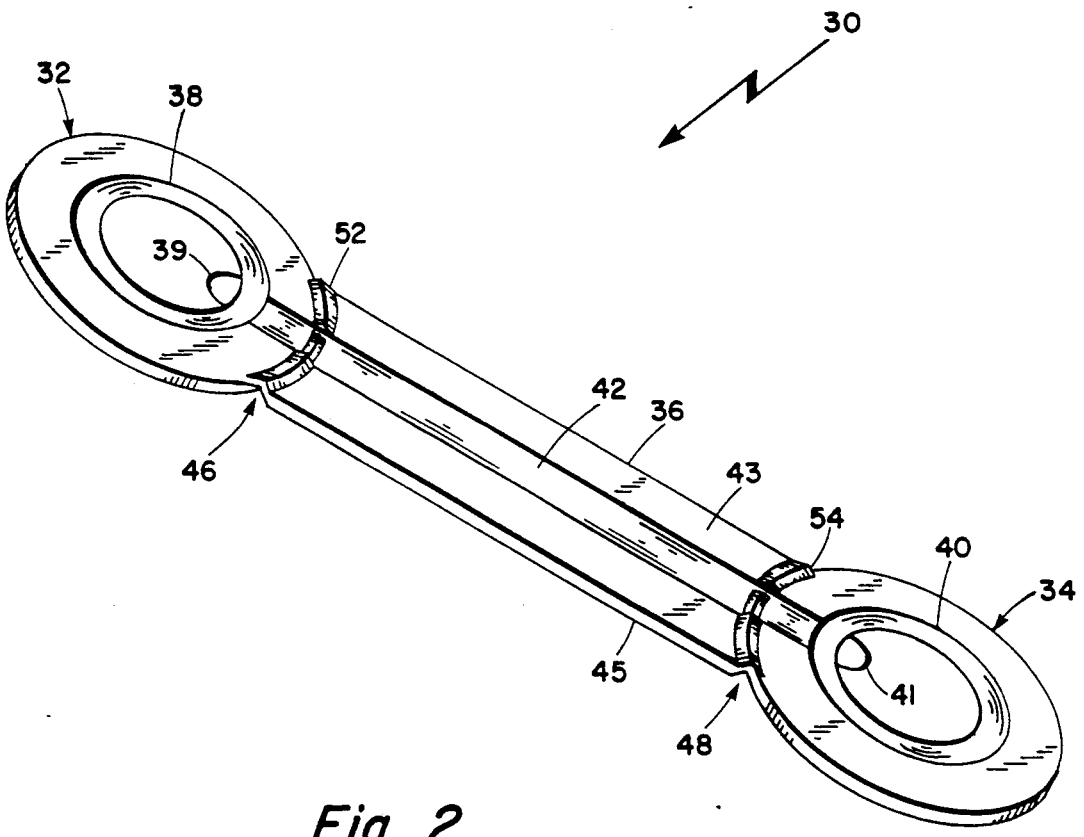
FIG. 2 is an isometric view of a transducer seal in accordance with the invention.

Referring now also to FIG. 2, the sealing means or seal 30 is shown to include a pair of end seal portions 32, 34 and a slot seal portion 36 disposed therebetween. The diameter of end seal portions 32, 34 is here approximately 4.75 inches and corresponds to the outer diameter of shell 12 so that in assembly, portions 32, 34 extend over the entire ends 14, 16 of shell 12 so that the perimeter thereof is flush with the curved sides 15 of shell 12. The length of slot seal portion 36 is here approximately 6.5 inches and corresponds to the length of the shell 12 (i.e. the distance between ends 16, 18). On the side 43 of seal 30 shown in FIG. 2, each of end seal portions 32, 34 has a circular groove 38, 40, respectively, disposed therein. Such grooves 38, 40 provide a corresponding ridge on the opposite side 45 of seal 30 as can be partially seen in FIG. 1 for end seal portion 32. Slot seal portion 36 also has a groove, or loop, 42 disposed therein, with such loop 42 similarly providing a corresponding ridge (not shown) on the opposite side 45 of seal 30.

In assembly, groove 42 extends into shell slot 22 and may thus, be referred to as a slot loop 42. As can be seen in FIG. 2, slot loop 42 extends along the length of slot seal portion 36 and additionally has portions 39, 41 extending slightly beyond end seal grooves 38, 40. Seal 30 further includes a pair of hinge portions 46, 48 disposed between end seal portions 32, 34 and slot seal portion 36, respectively. Hinge portions 46, 48 here serve to facilitate assembly of transducer 10 as will be discussed hereinafter. Suffice it here to say that each of hinge portions 46, 48 has a laterally oriented ridge 52, 54, respectively, extending above the side 43 of seal 30 in which grooves 38, 40 and slot loop 42 are disposed. Hinge portions 46, 48 have grooves (not shown) disposed on the opposite side 45 of seal 30 with a complimentary shape to ridges 52, 54.

As noted above, seal 30 is comprised of a compliant material and preferably an elastomer, such as rubber or polyurethane. Here, seal 30 is comprised of Nitrile rubber. The seal 30 is formed by compression molding in which a pair of plates is heated to a rubber deforming temperature and the plates are pressed against either side of a sheet of rubber. One of the plates has depressions therein corresponding to end seal grooves 38, 40 and slot 42; whereas, the other one of the plates has complimentary shaped ridges. Here, the compression molded seal 30 has a thickness of approximately 0.080 inches. Note however that it may be desirable to adjust the thickness of the seal 30 and/or the type of material used to provide such seal 30 in accordance with operating depth requirements. That is, for deeper sea operation where the stresses on the transducer 10 are significant, it may be desirable to use a stronger, or reinforced, elastomer material and/or to increase the thickness of the seal 30 to withstand such stresses.

With the use of transducer seal 30 (in place of conventional metal end plates), the efficiency of transducer 10 is improved. More particularly, efficiency is improved because shell 12 is uninhibited in its movement and also since acoustic energy is received in the case of transducer 10 operating as a hydrophone (or propagated when transducer 10 operates as a projector) through the end seal portions 32, 34 of seal 30.

The shell movement is relatively non-restricted because the end seal is comprised of a compliant material. More significantly however, such shell movement is eased because the grooves 38, 40 of end seal portions 32, 34, respectively, increase the compliance of the end seal portions 32, 34. As mentioned, when acoustic energy is propagated for example, the shell 12 moves in an oscillatory manner during which the slot 22 width increases and decreases. Because end seal portions 32, 34 are compliant, they stretch, or expand, and contract with the shell movements. Moreover, this expansion/contraction is eased by the grooves 38, 40. That is, the motion of shell 12 is such that the opposing shell edges (defining or bordering slot 22) move away from each other (i.e. radially outward) as shown by arrows 94 (FIG. 1) and over (i.e. tangential to the circumference of the cylindrical shell 12) as shown by arrows 92 (FIG. 1). Grooves 38, 40 assist in the movement of the end seal portions 32, 34, respectively, in the directions shown by arrows 92 and 94, thereby facilitating compliance of such end seal portions 32, 34 in accordance with corresponding shell movements. The portions 39, 41 of slot loop 42 that extend beyond grooves 38, 40 assist in the movement of end seal portions 32, 34 in the direction denoted by arrows 92. With this arrangement, shell 12 is free to move with negligible restriction by seal 30. Thus, the efficiency of transducer 10 is improved.

As noted, transducer efficiency is further enhanced since end seal portions 32, 34 receive and transmit acoustic energy. That is, as the shell 12 expands, the end seal portions 32, 34 move upward and when such shell contracts, the portions 32, 34 move downward. More particularly, the end seal grooves 38, 40 move upward and downward in accordance with the expansion and contraction of shell 12, thereby moving the entire end seal portions 32, 34 accordingly. This upward and downward motion of end seal grooves 38, 40 and end seal portions 32, 34 serves to propagate acoustic energy when transducer 10 operates as a projector and such motion serves to receive acoustic energy when transducer 10 operates as a hydrophone. Moreover, the energy propagated or received by end seal portions 32, 34 is in phase with the energy propagated or received by the cylindrical shell 12. Stated differently, instead of being acoustically inactive like conventional metal end caps, end seal grooves 38, 40 and end seal portions 32, 34 increase the radiating sound area, thereby increasing the efficiency of the transducer 10 by increasing the amount of output power.

Figure 3:
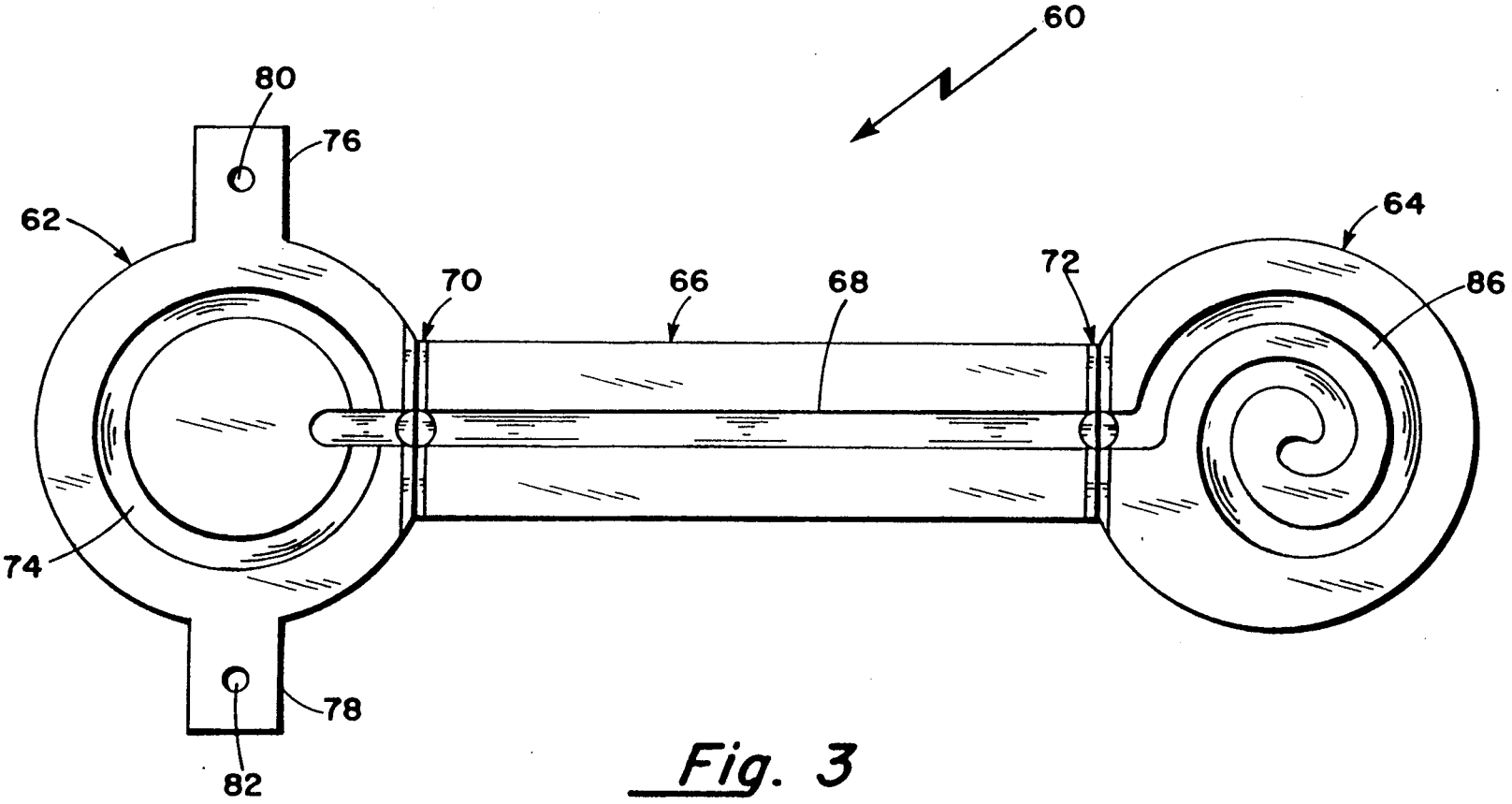
FIG. 3 is a plan view of a transducer seal in accordance with a further aspect of the invention.

Referring now to FIG. 3, an alternate embodiment 60 of the transducer seal 30 (FIG. 2) is shown to include end seal portions 62, 64 and a slot seal portion 66 disposed therebetween. Slot seal portion 66 has a slot loop 68 disposed therein and is identical to slot seal portion 36 of the embodiment of FIG. 2. Seal 60 further includes hinge portions 70, 72 identical to portions 46, 48 of seal 30 (FIG. 2). Further, like end seal portion 32 (FIG. 2), end seal portion 62 includes a circular groove 74. Here however, end seal portion 62 further includes a pair of attachment ears 76, 78. Attachment ears 76, 78 are provided for attaching transducer 10 to a buoy (not shown) for example, in a sonobuoy application. Here, ears 76, 78 are comprised of the same compliant material as seal 60 and are formed as a unitary member with seal 60. That is, attachment ears 76, 78 are formed when the seal 60 is compression molded. Ears 76, 78 have apertures 80, 82, respectively, disposed therethrough for attachment to a cable or line connecting transducer 10 to a buoy.

End seal portion 64 has a groove 86 disposed in a spiral shape, as shown. Spiral groove 86 is an alternate embodiment of circular groove 74 and improves the efficiency of transducer 10 in the same manner as described above for grooves 38, 40 of seal 30 (FIGS. 1 and 2). With regard to circular groove 74 (like similar grooves 38, 40 of seal 30), it is further noted that such groove 74 may be used to route wires, for example those wires used to connect transducer 10 to a buoy. This arrangement simplifies the manufacture of a sonobuoy in that a conventional spool mechanism may not required to launch the transducers 10 therefrom.

It is apparent from the above discussion of compression molding in conjunction with seal 30 (FIG. 2), that the resulting seal 30 is substantially flat but that in assembly, end seal portions 32, 34 are bent using hinges 46, 48 around the opposing ends 16, 18 of shell 12 to seal such ends 16, 18. Referring back to FIG. 1, the assembly of transducer 10 will be considered in greater detail in conjunction with seal 30 noting that like assembly is practiced with other seal embodiments such as seal 60 (FIG. 3). Resilient shell 12 is here formed of aluminum as is conventional. Here, the thickness of shell 12 is approximately 0.38 inches. Once shell 12 is formed, the electromechanical driver 20 is inserted therein through one of the ends 16, 18, as is conventional. A center column 98 (FIG. 4A) is then inserted into shell 12 and, in assembly, extends between end seal portions 32, 34. Center column 98 provides a housing for routing the wires coupling transducer 10 to a buoy, as mentioned. It is noted that the ac power source which provides the energizing input signals to transducer 10 may be disposed on a buoy or boat or may alternatively be provided internal to the transducer 10.

Epoxy is applied to portions of seal 30 which contact shell 12. That is, epoxy is applied to side 45 of seal 30, specifically, to the perimeter of the opposing end portions 32, 34, outside of the ridge corresponding to end seal grooves 38, 40. Epoxy is also applied to the area adjacent to the ridge corresponding to slot loop 42. The seal 30 is then positioned over shell 12 with the ridges (corresponding to end seal grooves 38, 40 and slot loop 42) disposed adjacent to the shell 12. That is, the grooves 38, 40, and slot loop 42 face away from shell 12 so that the ridges corresponding thereto, respectively, extend into shell 12 in assembly. Here, the epoxy used is sold under the product name Magnolia 55-2 by Magnolia Plastics Inc. of Chamblee, Ga.; however, any rubber to metal bonding epoxy is suitable. With this arrangement, the seal is pressed onto shell 12 so that the epoxy contacts the exterior of the shell 12 adjacent slot 22 and also contacts the rims 17, 19 of shell ends 16, 18, respectively. Note that rims 17, 19 are here approximately 0.38 inches wide and this area has been found to be suitable for bonding end seal portions 32, 34 to shell ends 16, 18, respectively. However, in applications where the thickness of shell 12 is too small to provide suitable sized rims 17, 19 for bonding, it may be desirable to extend the end seal portions 32, 34 over the sides 15 of shell 12.

Figure 4:
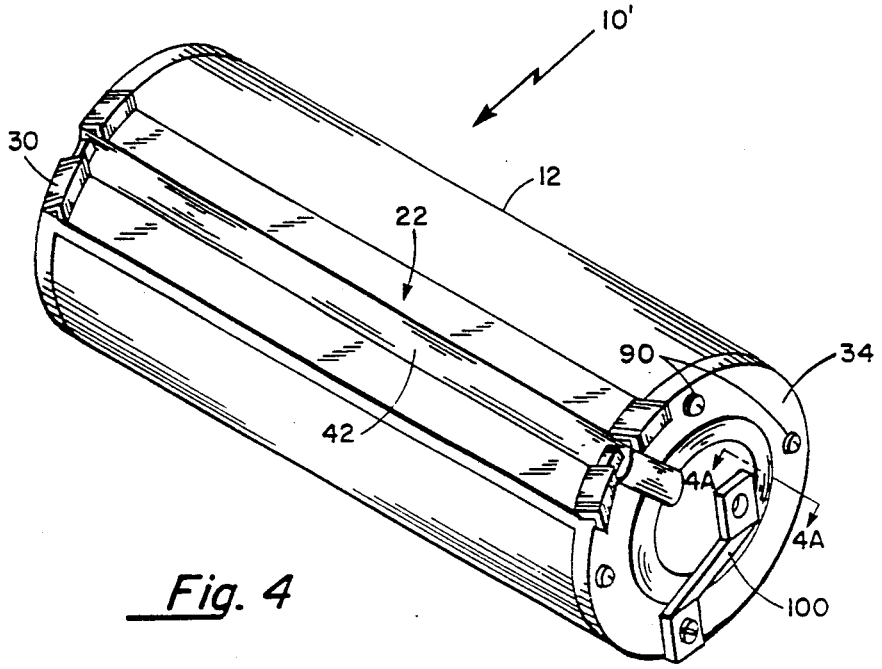
FIG. 4 is an isometric view of an assembled transducer in accordance with the invention.
Figure 4A:
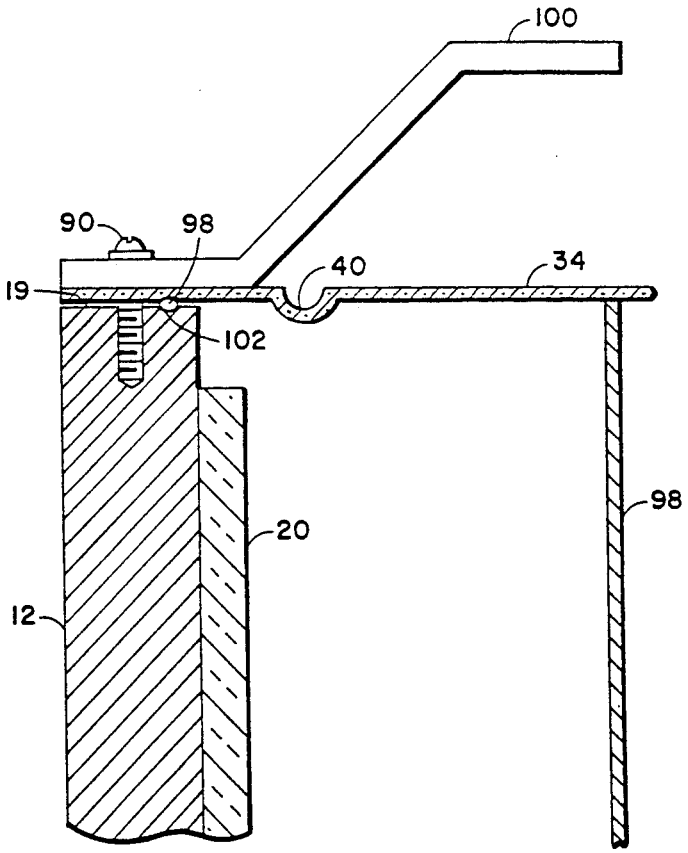
FIG. 4A is cross section of the transducer of FIG. 4 taken along line 4A—4A of FIG. 4.

An alternative method of assembling a transducer 10' in accordance with the invention is shown in FIGS. 4 and 4A. Referring first to FIG. 4, assembled transducer 10' is shown to include shell 12 and seal 30. As can be seen, slot loop 42 extends into shell slot 22 and end seal portion 34 covers transducer end 18. Here, a plurality of screws 90 secure end seal portions 32, 34 to the rims 17, 19 of transducer ends 16, 18 while epoxy is used to secure slot loop 42 to portions of shell 12 adjacent slot 22. Alternatively, additional screws may be used to secure slot loop 42 to shell portions adjacent slot 22. With this arrangement, seal 30 is readily removable to allow for maintenance and/or repair of transducer 10'. That is, it may be desirable to remove seal 30 to access the interior 14 of shell 12. Generally, screws 90, coupling end seal portion 34 to rim 19 (and likewise coupling end seal portion 32 to rim 17), are adequate to provide the requisite access since the interior components of the transducer 10 (such as the electromechanical driver 20) are easiest accessed through shell ends 16, 18, as opposed to slot 22.

Referring now also to FIG. 4A, a cross section of transducer 10 is shown taken along line 4A—4A of FIG. 4. Here, as an alternative to mounting ears 76, 78, shown in conjunction with seal 60 (FIG. 3), a rigid bar 100 provides means for coupling transducer 10' to other apparatus. A screw 90 is disposed through rigid bar 100 and is coupled to shell 12 opposite the slot 22, as shown. This arrangement is particularly desirable for use with heavier transducers 10' due to the added strength provided by rigid bar 100. The screw 90 disposed through rigid bar 100, and other like screws 90, are further disposed through the end seal portions 32, 34 and are secured to tapped holes disposed in rims 17, 19 of shell 12. Also provided are O-rings 98 disposed between end seal portions 32, 34 and rims 17, 19. O-rings 98 may be attached to end seal portions 32, 34 by any suitable adhesive or alternatively, may be formed integrally therewith. In assembly, O-rings 98 are disposed in contact with shell rims 17, 19 as shown in FIG. 4A for rim 19, to provide a watertight seal between transducer seal 30 and the shell 12. Here, shell rims 17, 19 have grooves 102 disposed adjacent the O-rings 98 for improving the watertight seal and assisting in the alignment of seal 30 with shell 12 during assembly.

It is noted that it may be desirable to provide a metal ring (not shown) disposed around the perimeter of end seal portions 32, 34 and over such portions 32, 34 with the metal ring having holes aligned with the tapped holes in shell rims 17, 19. Such a metal ring can be a separate piece or alternatively may comprise a vulcanized portion of end seal portions 32, 34. With such an arrangement screws 90 are disposed through the metal ring, end seal portions 32, 34, and into a corresponding tapped hole in shell rims 17, 19. The use of metal ring 96 reinforces the attachment of seal 30 to transducer 10' and may be desirable for use with heavier transducers or to improve the seal by providing a uniform compressive force on O-rings 98 around the entire perimeter of shell ends 16, 18. Note also that O-rings 98 may alternatively be disposed between such metal rings and end seal portions 32, 34.

With the above described arrangement, a watertight seal is provided having several benefits including improved operating efficiency, as described above. Additionally, the above described seals 30, 60 provide transducers with a smaller size than heretofore achieved. That is, conventional transducers utilize metal end caps over which an entire transducer covering rubber boot is disposed. Such metal end caps can have a typical thickness of 0.37 inches and are spaced from the ends 14, 16 of shell 12 by approximately 0.25 inches. Here however, such metal end caps are eliminated, thereby reducing the overall length of transducer 10 by approximately 1.25 inches. It may be desirable to take advantage of this reduced transducer length for example, in applications where transducers 10, 10' are disposed in a sonobuoy. Alternatively, it may be desirable to increase the length of the shell 12 to improve performance by increasing the radiating area, thereby increasing the efficiency and widening the operating bandwidth.

Another benefit of the transducer seals 30, 60 described herein is the manufacturing simplification. That is, the parts count of transducers 10, 10' has been reduced by two since instead of using a pair of metal end cap, and a boot disposed thereover, the present invention integrates the boot and end seals into a unitary part. The reduced parts count in turn reduces the manufacturing time and cost.

Having described the preferred embodiment of the invention, it is now evident that other embodiments incorporating their concepts may be used. For example, it should now be apparent that the seals 30, 60 described herein are readily adaptable for use with multi-slotted cylinder transducers by providing additional slot loop(s) for sealing the additional shell slots. It is further noted that circular and spiral grooves 74, 86 (FIG. 3) are exemplary and various other shaped grooves may be sued in end seal portions to provide the above described advantages. Also, end seal portions 32, 34 (FIG. 1) for example are easily adapted for use with an elliptical shaped flextensional transducer such as by modifying the shape of such portions 32, 34. Moreover, it may be desirable to utilize the end seal portions 32, 34 for covering the ends 16, 18 of shell 12 only, as opposed to further providing slot seal portion 42 for sealing shell slot 22. It is therefore felt that the invention should not be restricted to the disclosed embodiment but rather should be limited only by the spirit and scope of the appended claims.

What is claimed is:

1. An electroacoustic transducer comprising:

a resilient shell having an interior and a pair of opposing ends exposing said interior;

a transduction driver coupled to said resilient shell; and means, comprising a compliant material and disposed across at least one of said pair of opposing ends, for sealing said at least one of said pair of opposing ends, said sealing means comprising an end portion comprising means for increasing the compliance of said end portion.

2. The electroacoustic transducer recited in claim 1 wherein said compliant material is an elastomer.

3. The electroacoustic transducer recited in claim 1 wherein said increasing the compliance means comprises an annular groove.

4. The electroacoustic transducer recited in claim 1 wherein said increasing the compliance means comprises a spiral shape groove.

5. The electroacoustic transducer recited in claim 3 wherein said resilient shell has a slot exposing said interior and said sealing means comprises means for sealing said slot, said slot sealing means comprising a groove extending into said slot.

6. The electroacoustic transducer recited in claim 5 wherein said sealing means is fabricated as a single member.

7. An electroacoustic transducer comprising:

a resilient shell having an interior exposed by a pair of opposing ends and a slot;

a transduction driver coupled to said resilient shell; and a unitary compliant member comprising:

a first and second end portion disposed adjacent a corresponding one of the pair of opposing ends, each end portion comprising a groove extending toward the interior of said resilient shell; and a slot seal portion having a groove extending between said first and second end portion, said slot seal portion with said groove disposed adjacent said slot of the resilient shell.

8. The electroacoustic transducer recited in claim 7 wherein said compliant member is comprised of an elastomer.

9. The electroacoustic transducer recited in claim 7 wherein said groove of the end portion comprises an annular shape.

10. The electroacoustic transducer recited in claim 7 wherein said groove of the end portion comprises a spiral shape.

11. The elastomeric transducer recited in claim 7 wherein said unitary compliant member further comprises a pair of hinge portions, a first one of said pair of hinge portions disposed between the first end portion and the slot seal portion and the second one of said pair of hinge portions disposed between the second end portion and the slot seal portion.

12. A sonobuoy comprising at least one electroacoustic transducer, said at least one electroacoustic transducer comprising:

a resilient shell having an interior and a pair of opposing ends exposing said interior;

a transducer driver coupled to said resilient shell; and means, comprising a compliant material disposed across at least one of said opposing ends, for sealing said at least one opposing end, said sealing means comprising: an end portion comprising means for increasing the compliance of siad end portion disposed across the at least one opposing end.

* * * * *